US007418896B1

(12) United States Patent
Dindl et al.

(10) Patent No.: US 7,418,896 B1
(45) Date of Patent: Sep. 2, 2008

(54) RECOILLESS WEAPON SYSTEM

(75) Inventors: Frank Dindl, Newton, NJ (US); Kenneth R. Jones, Wayne, NJ (US); Richard Beckman, Randolph, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 431 days.

(21) Appl. No.: 10/906,944

(22) Filed: Mar. 14, 2005

Related U.S. Application Data

(60) Provisional application No. 60/593,085, filed on Dec. 8, 2004.

(51) Int. Cl.
*F41A 1/08* (2006.01)
*F41A 19/00* (2006.01)

(52) U.S. Cl. ..... 89/1.701; 89/1.702; 89/1.705; 102/437

(58) Field of Classification Search ..... 42/1.06; 102/437; 89/1.7–1.706
See application file for complete search history.

(56) References Cited

U.S. PATENT DOCUMENTS

| | | | | |
|---|---|---|---|---|
| 1,108,717 | A * | 8/1914 | Davis | 102/430 |
| 1,311,021 | A * | 7/1919 | Spear et al. | 89/1.702 |
| 3,216,323 | A * | 11/1965 | Wengenroth et al. | 89/1.701 |
| 3,489,058 | A * | 1/1970 | Andersson et al. | 89/1.705 |
| 4,586,420 | A * | 5/1986 | Toutin | 89/1.702 |
| 5,811,715 | A * | 9/1998 | .ANG.sbrink | 89/29 |
| 2004/0069174 | A1 * | 4/2004 | Dorn et al. | 102/437 |

FOREIGN PATENT DOCUMENTS

WO WO 212818 A1 * 2/2002

* cited by examiner

*Primary Examiner*—Michelle Clement

(57) ABSTRACT

A recoilless weapon system is provided rear portion, a barrel in movable connection to the rear portion, and a handle portion in removable connection with the barrel and/or rear portion. Further, a ballast payload cartridge is removably disposed within a ballast payload cartridge portion of said rear portion, and serves as a center breach to support a combat cartridge. The ballast payload cartridge may have a side primer disposed therein, which allows a single weapon firing pin to simultaneously initiate both the combat cartridge primer and the ballast payload cartridge primer.

1 Claim, 5 Drawing Sheets

RECOILLESS WEAPON SYSTEM

CROSS REFERENCE TO RELATED APPLICATIONS

This application claims benefit under 35 USC 119(e) of provisional application 60/593,085 filed Dec. 8, 2004 the entire file wrapper contents off which are incorporated by reference herein as though fully set forth.

FEDERAL RESEARCH STATEMENT

The inventions described herein may be made, used or licensed by or for the U.S. Government for U.S. Government purposes.

BACKGROUND OF THE INVENTION

In conventional recoilless weapon systems, a ballast charge (ballast cartridge) is simultaneously discharged at the time of firing from the rear of the weapon, so as to counteract the recoil produced by the firing of the ammunition. Such a ballast charge is generally relatively heavy, and must be supported by a heavily built center breach. The necessary provision of such a heavy center breach adds significantly to the overall weight of the weapon.

In particular, to fire existing combat ammunition while simultaneously firing a ballast cartridge would typically require a common breach and/or a dual acting firing system. For example, two firing pins would generally be required, to simultaneously fire the ballast cartridge and the ammunition using a single trigger pull. In the event that the ballast cartridge is not fired simultaneously with the firing of the ammunition, propellant gases will escape from the base of the ballast cartridge, mitigating recoil from firing.

Thus, conventionally, recoilless weapons suffer from both undesirable overall mass, due to the need for a heavy center breach mechanism, and are fairly mechanically sophisticated, due to the need for a complicated simultaneous firing mechanism to ensure simultaneous firing. It has been found that such conventional recoilless weapons are difficult for the user to transport in battle, and that the more sophisticated the mechanism (such as the conventional firing mechanisms), the more likely misfires are to occur.

OBJECTS OF THE INVENTION

Thus, it is an object of the present invention to provide a lightweight recoilless weapon, which would be easy to carry in battle. As such, it is an object of the invention to provide a recoilless weapon requiring no center breach, which is a major contributor to weapon weight. Further, it is an object of the present invention to provide a firing mechanism for a recoilless weapon that may provide simultaneous firing while also providing a high degree of reliability.

It is a further object of the present invention to provide a recoilless weapon with all of the above described features, which are capable of firing existing percussion, or electric primed combat ammunition. For example, a recoilless weapon capable of firing 20 mm, 25 mm, 40 mm and .50 caliber ammunition is desired.

SUMMARY OF THE INVENTION

In order to achieve the objects of the present invention, a recoilless weapon system is provided, comprising: a rear portion having a ballast payload cartridge containment portion and a primer port formed therein; a barrel in movable connection to said rear portion, said barrel having a chamber therein containment of a cartridge, the chamber having a mouth; and a handle portion in removable connection with said barrel and/or rear portion, said handle portion comprising a grip, a trigger and a firing pin in movable connection with said trigger, said firing pin in proximity to said primer port of said rear portion.

In another embodiment of the invention, a recoilless weapon system is provided, further comprising a ballast payload cartridge removably disposed within said ballast payload cartridge containment area of said rear portion, said ballast payload cartridge comprising: a base; a forward portion; a side primer disposed in the forward portion of the ballast cartridge adjacent said base; a propellant cavity; a ballast payload disposed rearward of the propellant cavity; and a firing pin disposed forward of the propellant cavity, wherein said firing pin is activated by initiation of said primer and commensurate expansion of propellant gases through said propellant cavity.

In still another embodiment of the present invention a recoilless weapon system is provided, wherein the base of said ballast payload cartridge has a circumference larger in diameter than a circumference of the chamber of said barrel.

In yet another embodiment of the present invention, a recoilless weapon system is provided, further comprising a ballast payload cartridge removably disposed within said ballast payload cartridge containment area of said rear portion, said ballast payload cartridge comprising: a base; a forward portion; a side primer disposed in the forward portion of the ballast cartridge adjacent said base, so as to be disposed adjacent the primer port of the rear portion when loaded into the weapon; a propellant gas expansion chamber adjacent said side primer, said propellant gas expansion chamber having a ballast payload port and a combat cartridge primer port; a propellant cavity primer adjacent said ballast payload port; and a propellant cavity adjacent said propellant cavity primer; wherein a primer disposed on a combat cartridge loaded into the chamber of the barrel, and the propellant cavity primer, are simultaneously initiated by the initiation of said side primer and commensurate expansion of propellant gases through said propellant gas expansion chamber.

In a further embodiment of the present invention, a recoilless weapon system as above is provided which further comprises: a first firing pin disposed in the propellant gas expansion chamber adjacent said combat cartridge primer port, and a second firing pin disposed in the propellant gas expansion chamber adjacent said ballast payload port.

DETAILED DESCRIPTION OF THE DRAWINGS

Figure 1:
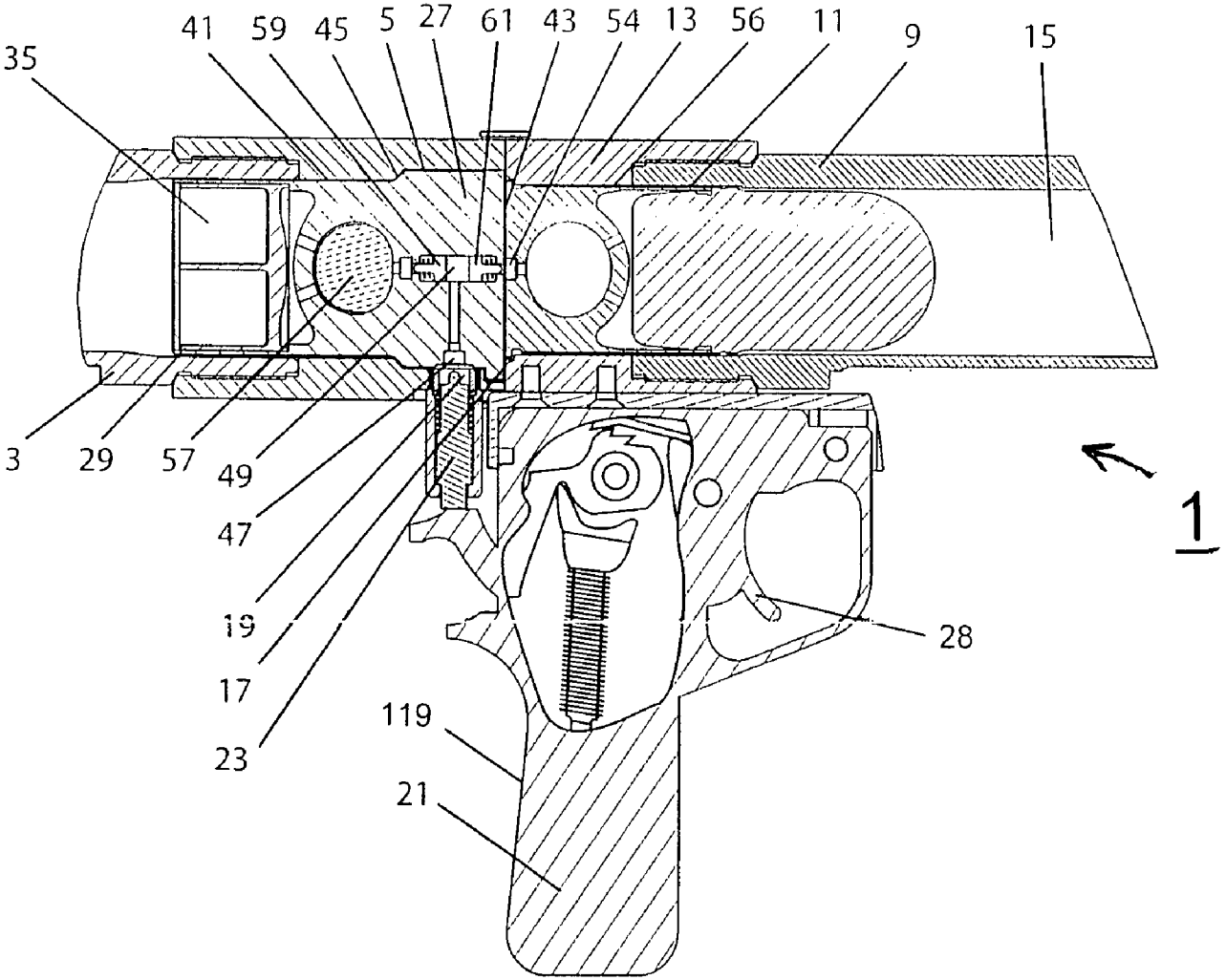
FIG. 1 is a partial cross-sectional side view of various embodiments of the present invention.

As illustrated in FIG. 1 herein, the recoilless weapon comprises a rear portion 3 having a ballast payload cartridge containment portion 5 and a primer port 47 formed therein.

Attached to the rear portion 3 is a barrel 9, in movable connection to the rear portion. For example, the rear portion 3 may be attached to the barrel 9 via a hinge.

The barrel 9 has a chamber 11 formed therein at a rear portion 13 thereof, for containment of a cartridge (i.e., a combat cartridge). The chamber 11 is comprised of a cartridge containment area 15, and a mouth 17 having a circumference with a diameter wide enough to accommodate a combat cartridge of choice.

A handle portion 119 is provided in removable connection with the rear portion 3 and/or the barrel 9. The handle portion 119 is comprised of a grip 21, a trigger 28 disposed adjacent the grip 21, and a firing pin 23 in movable connection with the trigger 28. Importantly, the firing pin 23 is disposed within proximity of the primer port 47 formed in the said rear portion 13 of the weapon.

Figure 2:
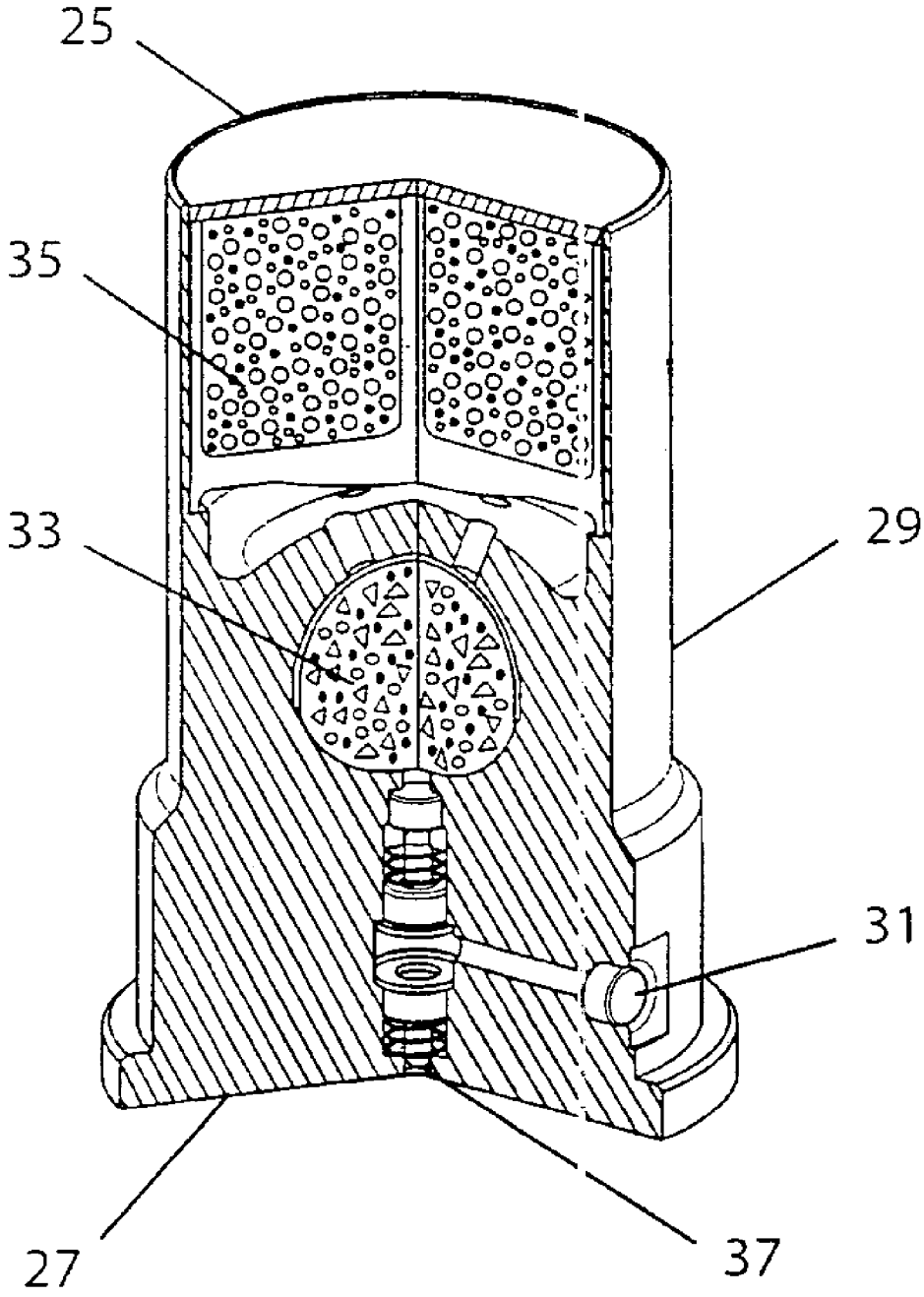
FIG. 2 is a perspective view, partially cut away, of the ballast payload cartridge of the present invention.

As illustrated in FIGS. 1 and 2, the recoilless weapon system may further comprise a ballast payload cartridge 25, which is removably disposed within the ballast payload cartridge containment portion 5 of the rear portion 3. The ballast payload cartridge 25 comprises a base 27, a forward portion 29, a side primer 31 disposed in the forward portion 29, a propellant cavity 33, a ballast payload 35 disposed rearward of the propellant cavity 33, and a ballast payload cartridge firing pin 37 disposed forward of the propellant cavity 33.

As shown in FIG. 1, whereas conventional recoilless weapons have a center breach to support the cartridge, the recoilless weapon system 1 of the present invention utilized the rim of the ballast cartridge to perform this function (i.e., to serve as a breach, which supports the base of the combat cartridge, and closes off the base of the barrel). When the trigger 23 is pulled by a user, the firing pin 23 initiates the primer, causing commensurate expansion of propellant gases through said propellant cavity 33. This propellant gas then triggers the ballast payload cartridge firing pin 37, which then initiates the combat cartridge primer 39.

This configuration allows near simultaneous firing of both the ballast payload cartridge 25 and combat cartridge, while eliminating the need for a complicated simultaneous firing mechanism. Furthermore, the base 27 of the ballast payload cartridge 25 acts as a breach, and eliminates the need for a heavy, integrated center breach for support of the combat cartridge. So, by make the ballast cartridge rim act as a breach, with a side primed ballast cartridge (wherein the firing pin strikes a primer located on the side f the cartridge above the rim (i.e., on the "belt"), Optionally, a user may be able to further reduce the amount of ballast payload needed by launching the ballast slightly later (or slightly sooner) than the combat cartridge.

Figure 3:
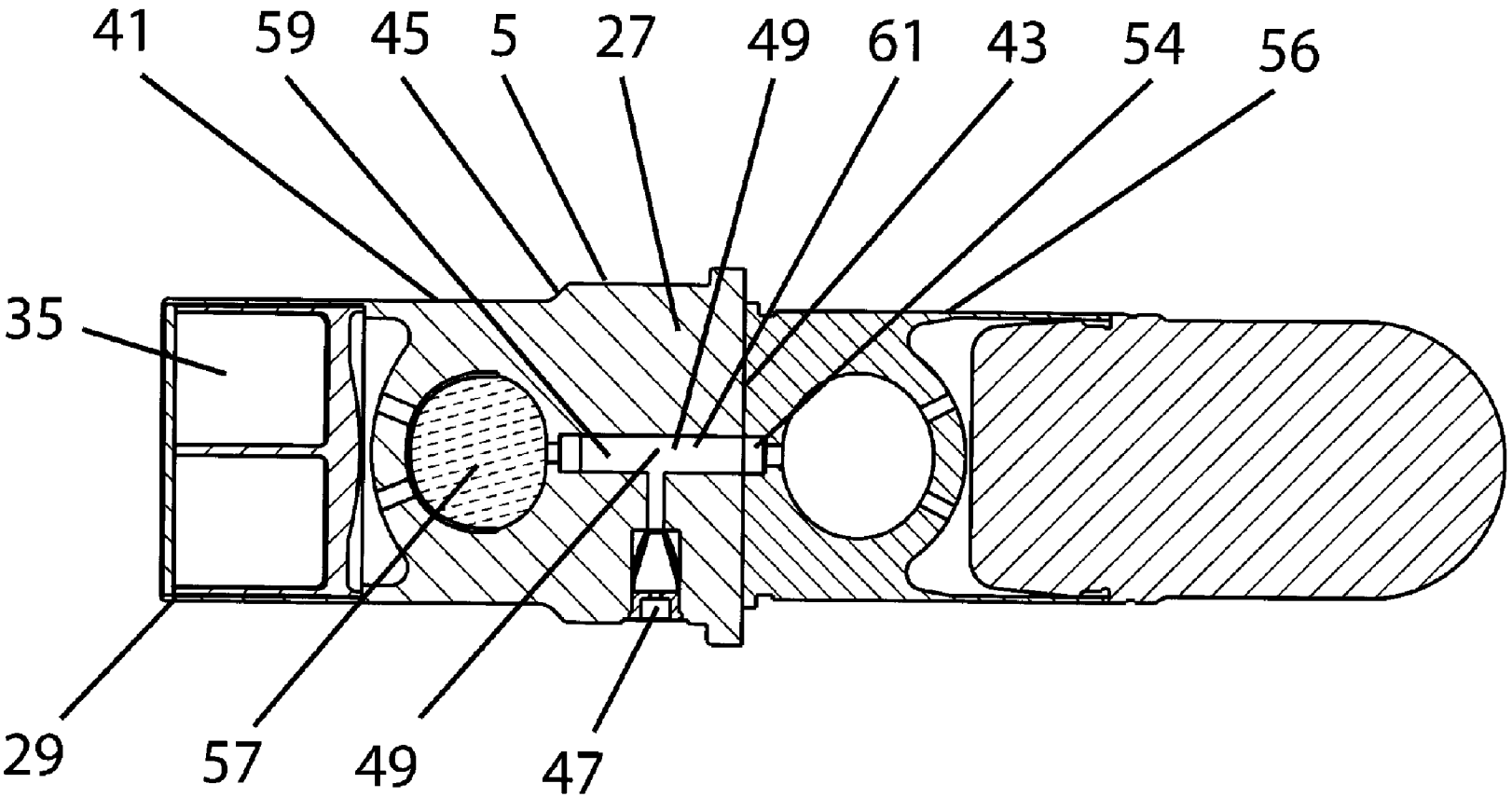
FIG. 3 is a cross-sectional side view of the present invention, illustrating the relationship of the ballast payload cartridge with a combat cartridge, when both are loaded into the recoilless weapon system.

An alternative configuration of the ballast payload cartridge 41, as illustrated in FIG. 3, may be removably disposed within said ballast payload cartridge portion 5 of said rear portion 3. This ballast payload cartridge 41 is comprised of a base 43, a forward portion 45, and a side primer 47 disposed in the forward portion 45 of the ballast payload cartridge 41 adjacent the base 43, so as to be disposed adjacent the primer port 7 of the rear portion 3 when loaded into the weapon 1.

A propellant gas expansion chamber 49 is disposed adjacent the side primer 47, the propellant gas expansion chamber 49 having a ballast payload port and a combat cartridge primer port opposite the combat cartridge primer 54 of combat cartridge 56. A propellant cavity primer is disposed adjacent the ballast payload port, and a propellant cavity 57 is disposed adjacent the propellant cavity primer. When the side primer 47 is initiated by the firing pin 23, propellant gases are created, which expand rapidly and simultaneously initiate a primer disposed on a combat cartridge disposed in the chamber 11, and the propellant cavity primer.

Figure 4:
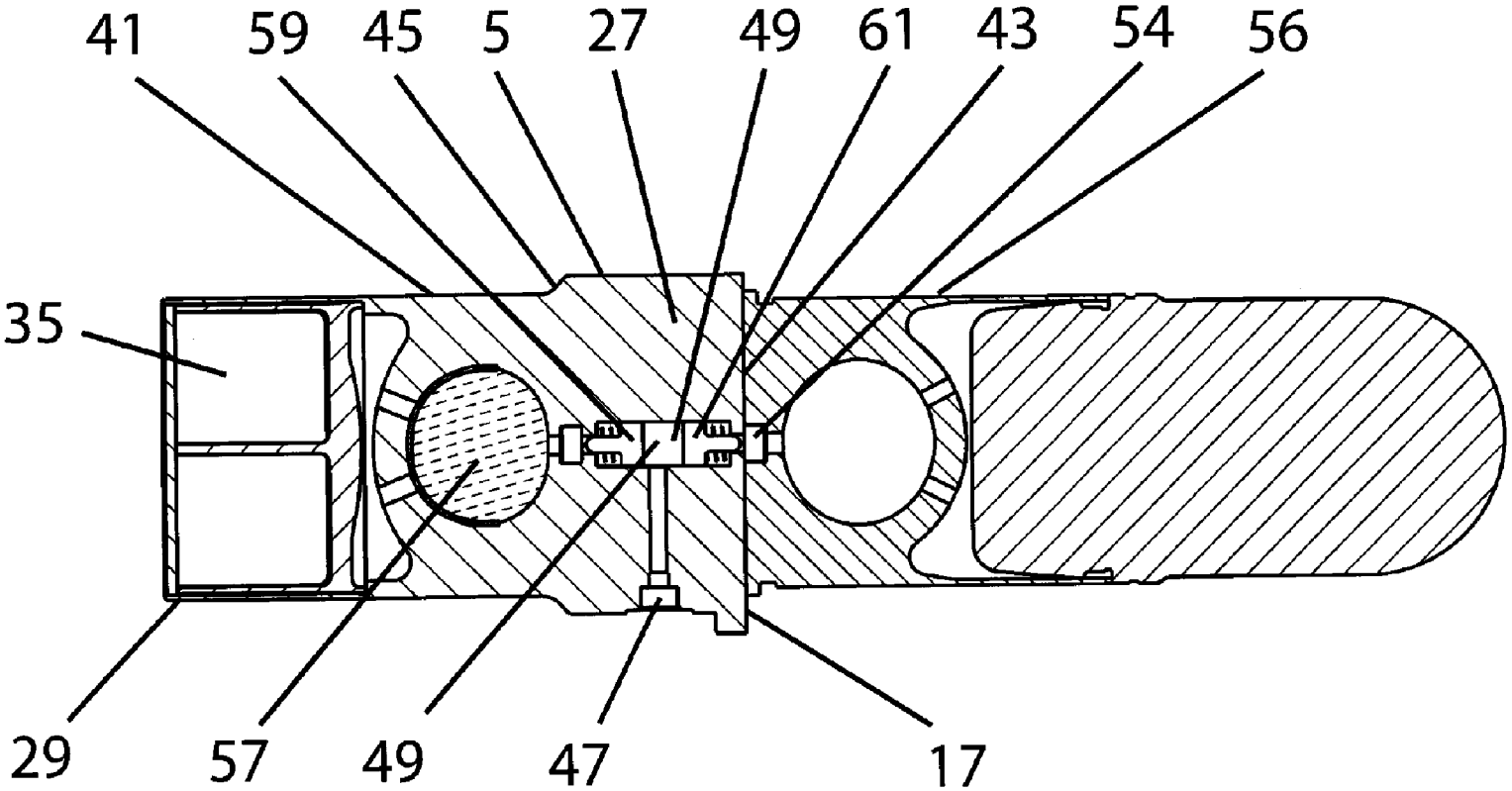
FIG. 4 is a cross-sectional side view of the invention, illustrating the relationship of the ballast payload cartridge with a combat cartridge, when both are loaded into the recoilless weapon system.

Alternatively, as illustrated in FIG. 4, the recoilless weapon system described above may further comprise a first firing pin 59 disposed in the propellant gas expansion chamber 49 adjacent the combat cartridge primer port, and second firing pin 61 disposed in the propellant gas expansion chamber 49 adjacent the ballast payload port by providing additional firing pins for initiation of the primers disposed on the ballast payload cartridge and combat cartridge, reliable and simultaneous firing of the ballast payload cartridge and combat cartridge can be obtained.

Figure 5:
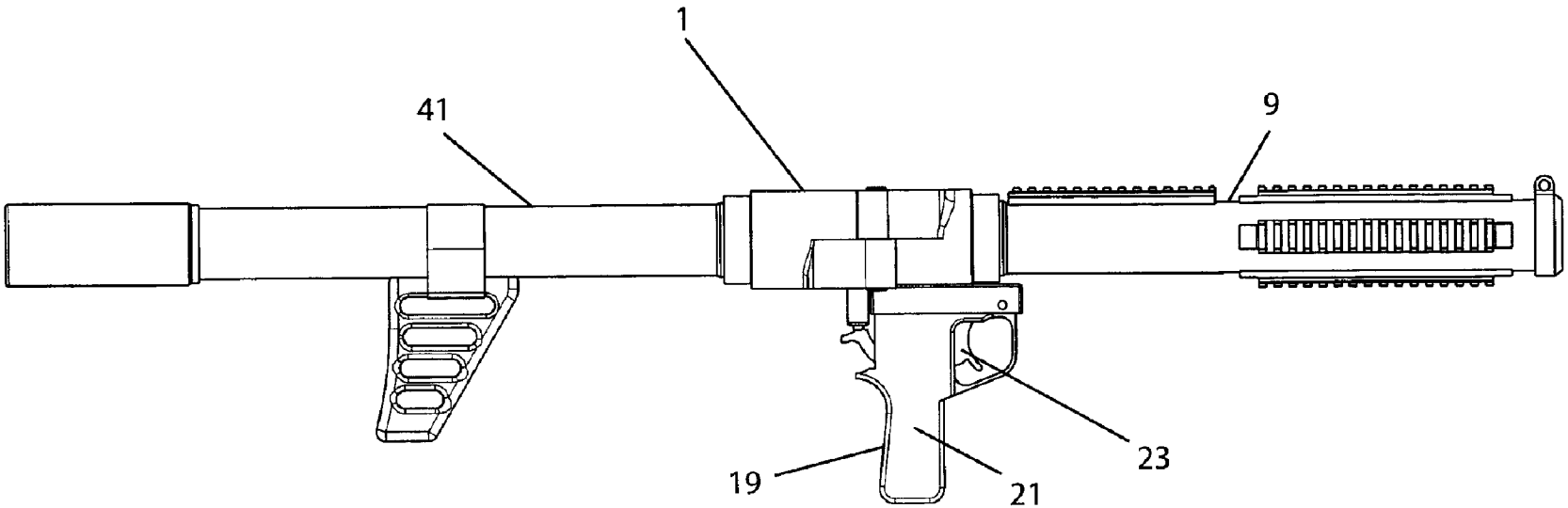
FIG. 5 is a side view of the present invention, illustrating the general configuration of a recoilless weapon of the present invention.

As illustrated in FIG. 5 herein, by utilizing the embodiments of the present invention, a very lightweight recoilless weapon system can be obtained, having no cumbersome center breach. Further, by using the ballast payload cartridge to act as a center breach, gas sealing is provided, which avoids the possibility that gas will be vented out between the ballast and the combat cartridge. Such undesirable gas venting may cause a delay in firing or undesirable gas venting to the gunner and/or erosion of the gun barrel.

Thus, the present invention provides the following advantages over conventional recoilless weapons: (1) no center breach; the base of the ballast payload cartridge performs this function; (2) Side-primed ballast cartridge; allows elimination of a center breach, while also allowing use of conventional existing combat ammo; (3) Symmetrical firing scheme; this minimizes weapon movement (recoil) during firing, which maximizes gunner comfort and system accuracy (you can better target the weapon); (4) the firing pin base may be located in the base of the ballast cartridge.

What is claimed is:

1. A recoilless weapon system comprising:

a rear portion having a ballast payload cartridge containment portion and a primer port formed therein;

a barrel in movable connection to said rear portion, said barrel having a chamber therein for containment of a cartridge, the chamber having a mouth; and a handle portion in removable connection with said barrel and/or rear portion, said handle portion comprising a grip, a trigger and a firing pin in movable connection with said trigger, said firing pin in proximity to said primer port of said rear portion, further comprising: a ballast payload cartridge removably disposed within said ballast payload cartridge containment portion comprising:

a base;

a forward portion;

a side primer disposed in the forward portion of the ballast cartridge adjacent said base, so as to be disposed adjacent the primer port of the rear portion when loaded into the weapon;

a propellant gas expansion chamber adjacent said side primer, said propellant gas expansion chamber having a ballast payload port and a combat cartridge primer port;

a propellant cavity primer adjacent said ballast payload port; and a propellant cavity adjacent said propellant cavity primer;

wherein a primer disposed on a combat cartridge loaded into the chamber of the barrel, and the propellant cavity primer, are simultaneously initiated by the initiation of said side primer and commensurate expansion of propellant gases through said propellant gas expansion chamber, and wherein said firing pin further comprises:

a first firing pin disposed in the propellant gas expansion chamber adjacent said combat cartridge primer port, and a second firing pin disposed in the propellant gas expansion chamber adjacent said ballast payload port.

* * * * *